United States Patent [19]

Geay

[11] 4,018,300

[45] Apr. 19, 1977

[54] STAIRS

[75] Inventor: Gilbert Louis Geay, Cours, France

[73] Assignee: Menuiserie du Val de Rhins R. Boucher S.A., France

[22] Filed: Feb. 12, 1975

[21] Appl. No.: 549,147

[30] Foreign Application Priority Data

Feb. 26, 1974 France ..... 74.06751

[52] U.S. Cl. ..... 182/178; 182/194; 182/228; 52/182

[51] Int. Cl.² ..... E04F 11/00

[58] Field of Search ..... 182/178, 194, 228, 220, 182/216; 52/182, 187, 188, 758 F, 758 R, 758 C, 753 E, 753 R, 753 Y, 754, 753 C; 403/393, 408

[56] References Cited

UNITED STATES PATENTS

| | | | |
|---|---|---|---|
| 2,257,001 | 9/1941 | Davis | 52/753 E |
| 3,473,275 | 10/1969 | Lappin | 52/187 |

FOREIGN PATENTS OR APPLICATIONS

| | | | |
|---|---|---|---|
| 2,065,332 | 7/1971 | France | 52/187 |

*Primary Examiner*—Reinaldo P. Machado
*Attorney, Agent, or Firm*—Stevens, Davis, Miller & Mosher

[57] ABSTRACT

This case discloses a stairway having a plurality of treads which are compressed between spacer blocks functioning as stringers. The compression is effected by rods, the heads of which are encased in mortises which are suitably covered.

11 Claims, 4 Drawing Figures

FIG. 1
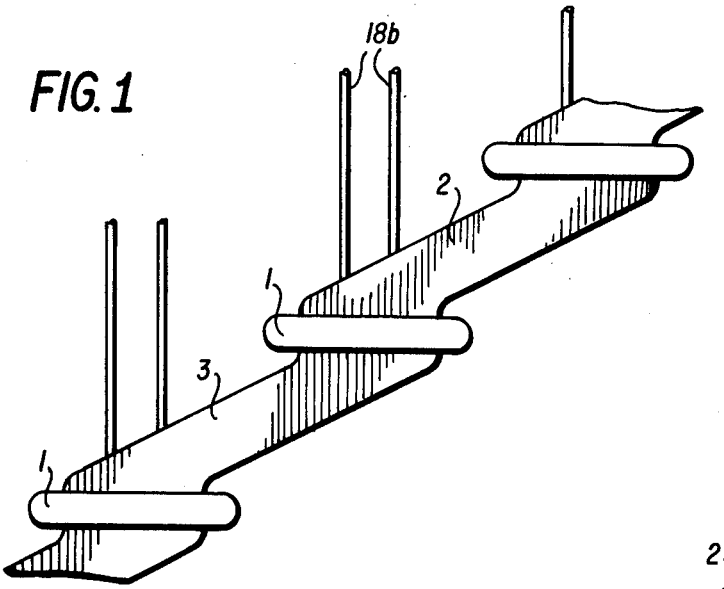
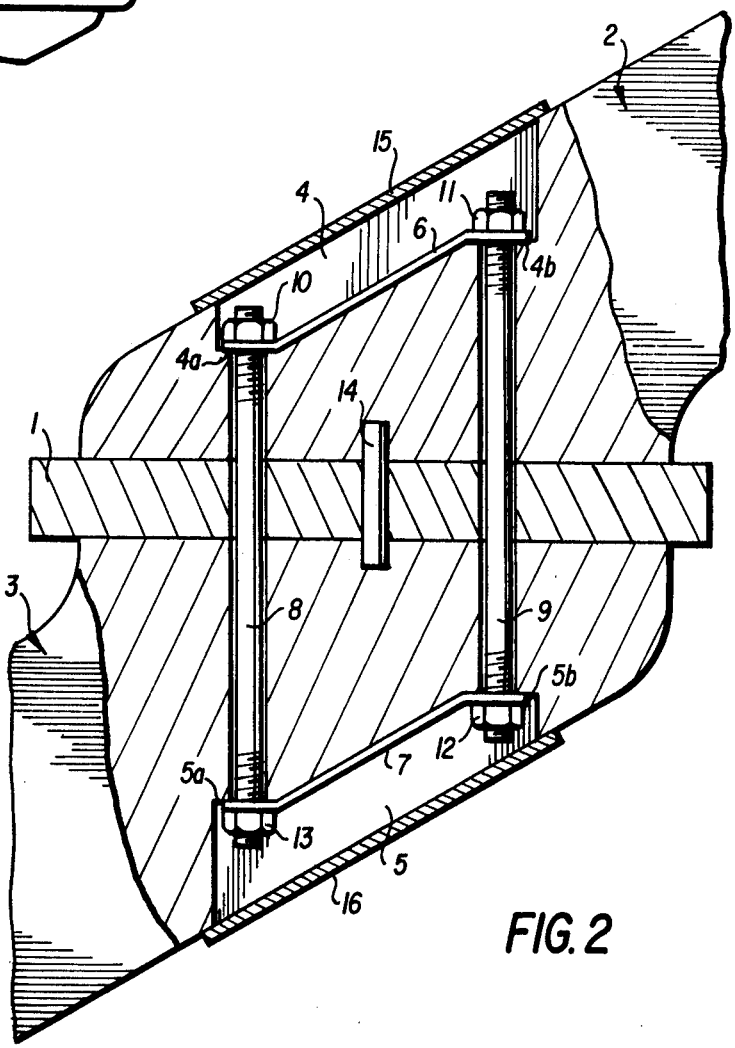
FIG. 2

STAIRS

The present invention relates to a new type of stairway which may be made of wood, metal or other material. By "stairway" is meant a series of stages for ascending or descending constituted by steps which are parallel to each other and which are spaced apart vertically whether equally or not. The stairways of the present invention may be straight, turning at different angles as with ramps, curved, circular, of the screw type, or spiral with a hollow interior. These may be one or several units functioning to replace the stringers of prior art construction. While the following description deals with the construction of stairways of wood, the invention is not at all limited to such material, the invention being equally applicable to stairways of metal, plastic or other materials.

Briefly, to build a stairway according to the prior art, one prepares stringers (pieces of wood notched out) on which one puts the treads. This very widespread arrangement presents a problem, however, particularly in mass production, because the height of the risers is predetermined. Usually all of the risers are mutually equal, so that it is difficult to adapt the stringers to various heights or contours of stairway between two floors or landings.

In French Pat. No. 2,065,332, there is described a new type of stairway, usually metallic, in which each step or tread is clamped between two brace pieces and in which the whole is assembled by compression rods functioning also to support the hand rail. This type of stairway in which the spindles serve as the point of support of the treads and stringers is adapted for outside but not interior use. Furthermore, it is difficult to assemble even without taking into account that between two spindles one has at the separation of a step which diminishes the safety of this type of stairway.

In Swiss Pat. No. 534,787 a stairway with variable geometry is described and in which the compression element does not compress two holding or spacing blocks.

The present invention overcomes the disadvantages of the prior art. It relates to a new type of stairway in which at least each one of the lateral edges of tread is compressed between two spacer blocks, each spacer block having at least two mortises located on the opposite free edges. The lower such mortise of the spacer block situated under the tread and the mortise of the adjacent spacer block located above the tread are symmetrical with respect to the tread, upper and lower being here used in the sense of direction of flight of the stairway. Each mortise receives fixing and spacer or clamping pieces. These extend between the corresponding mortises of the clamping block above the tread and the clamping or spacer block below it, being disposed in channels provided in the clamping blocks and extending through the stair tread.

It is advantageous to provide each clamping block or tread spacer block with two mortises one on its upper free edge and the other on its lower free edge. In practice the bottoms of each mortise cavity are parallel although inclined in relation to the treads of the stairway. It is advantageous that each tread be compressed at its two side edges between clamping blocks according to the present invention.

To assure better stability and to facilitate installation, a pin is provided for which is fixed in orificies provided for it in the two compression or spacer blocks above and below a tread. It extends through the tread from one side to the other and serves as a locator.

As hardware for fixing and clamping together the tread spacing blocks, one can use rods the extremities of which are bolted in each mortise. It is advantageous that these rods acts as anchor points for the banisters of the hand rail located parallel to, above and on the edge of the stairway.

Particularly with wooden stairways, it is desirable to put into each mortise a rigid plate piece, for example of metal, approximately conforming to the shape of the bottom of the mortise and having holes in it appropriately positioned and of appropriate dimensions. The fastening and compressing hardware will act through these rigid pieces since the nuts on the threaded rods will bear against them.

For aesthetic reasons, each mortise may be covered with a little plaque made, for example, of wood.

The way in which the invention may be practiced and the advantages which it affords may be best appreciated from a reading of the description of the following examples in conjunction with the drawings, these examples being indicative rather than limiting of the scope of the invention.

IN THE DRAWINGS

FIG. 1 is a schematic view in side elevation of a fragment of a stairway constructed in accordance with the teachings of the present invention; FIG. 2 is a view to an enlarged scale partially in elevation and partially in vertical section and showing fragment of a stairway constructed in accordance with the principles of the present invention;

Figure 4:
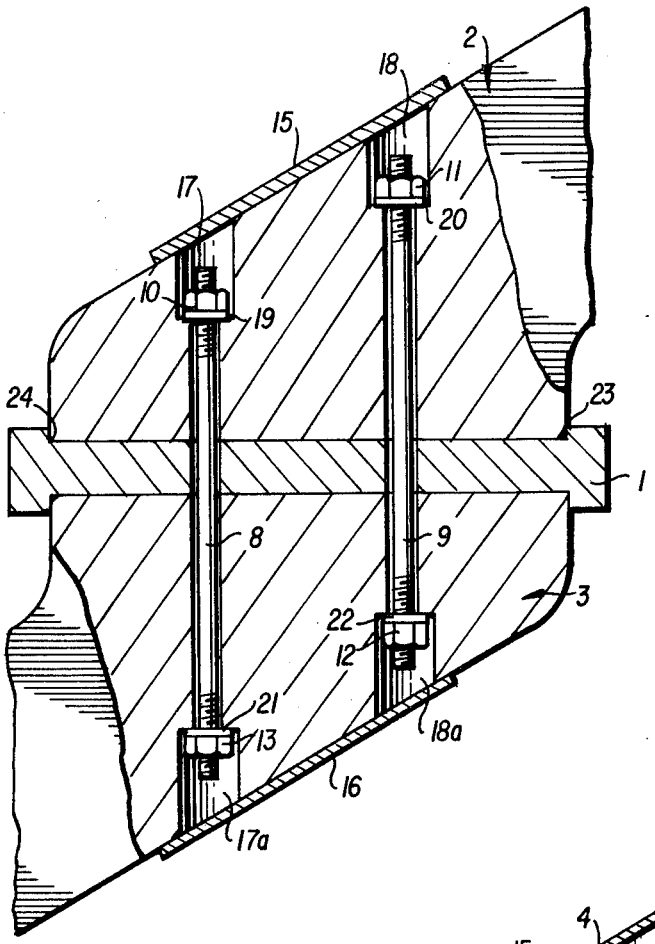
FIG. 4 is also a view similar to FIG. 2 but showing still another embodiment of the invention.

Referring now in greater detail to the drawings, the numeral 1 designates the tread of a wooden stairway, the width and depth of which is appropriate. The numerals 2 and 3 represent two compression or spacing blocks also of wood and compressing between them the tread 1, the blocks being respectively above and below said tread 1 as can be seen in FIGS. 1 and 2. The reference numeral 4 designates an inclined mortise cut into the upper free edge of the spacing block 2, the lower defining surface of the mortise presenting surfaces **4*a* and 4*b* substantially parallel to the tread. The mortise 5 is also inclined being cut into the lower spacer block 3 substantially symmetrically to the mortise 4 in the block 3 in relation to the tread 1 of the stairway and also having flats 5*a* and 5*b* parallel to the tread 1**.

The reference numerals 6 and 7 designate metal plates conforming to the contours of the bottoms of the mortises 4 and 5 respectively. There are holes, not numbered, in the ends of these plates through which rods 8 and 9 which are threaded at each end traverse the sandwich made up of block-tread-block. For holding the assembly firmly together, nuts 10, 11, 12 and 13 are screwed onto the threaded extremities of the rods 8 and 9 and exert their compression through metal plates 6 and 7.

For facilitating assembly there if a wooden positioning pin 14 located in two holes provided for it in the bottom and top respectively of two adjacent spacer blocks, said pin 14 passing through the tread from the upper block into the lower one.

To make the assembled stairway have a better appearance, the mortises 4 and 5 can be hidden by wooden cover plaques 15 and 16 respectively, nailed or stapled over the edge of the particular spacer block.

The banisters **18*b* which serve to support a hand rail, not shown, are screwed to the upper ends of the rods 8 and 9. In such a case the cover 15** is provided with holes appropriate to the passage of the banisters.

Figure 3:
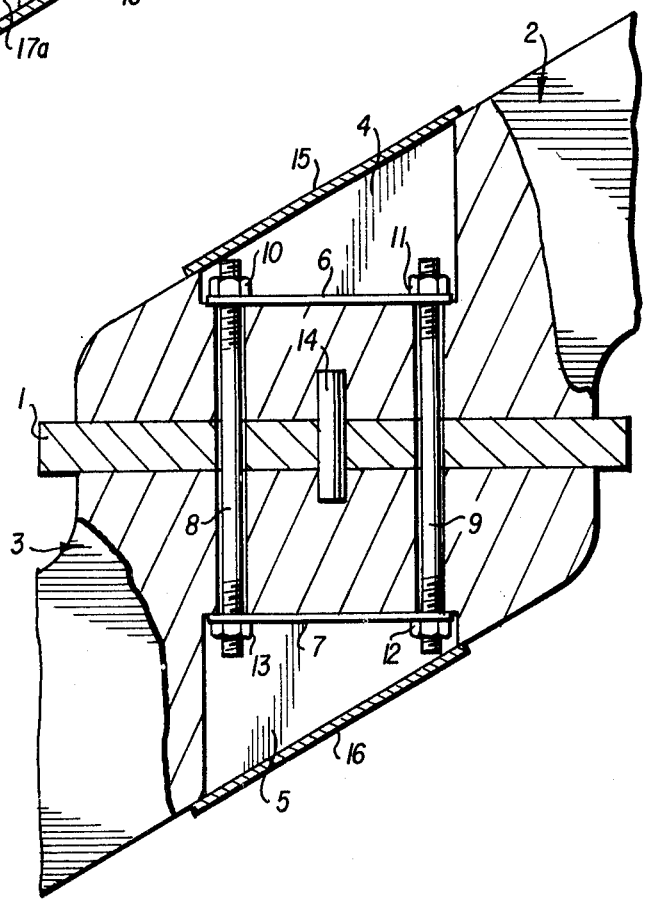
FIG. 3 is a view similar to FIG. 2 but showing a second embodiment of the invention.

In the embodiment of FIG. 3, the interior faces of the mortises 4 and 5 do not follow the line of slope of the stairway as is the case in the FIG. 2 construction. Instead, it stays parallel to the tread 1 so that in this case the compression plates 6 and 7 are flat and rectangular.

A form of the invention especially adapted to woods having great mechanical strenght, such as oak or sipo, is shown in FIG. 4. In this form the single mortises such as 4 and 5 of FIGS. 2 and 3 are replaced by two small mortises **17, 18, 17*a*, 18*a*, respectively forming shoulders for receiving nuts 10, 11, 12 and 13 and washers 19, 20, 21 and 22, the washers replacing the plates 6, 7** of the previous figures.

If desired, one can do without the pin 14 and fashion a groove in each tread to facilitate assembly. See again, FIG. 4 and 23 and 24.

The hand rail, not shown, may be formed in a conventional way from a single piece or of various elements constructed and arranged according to the effect desired.

Finally, in a particularly economical form of construction with risers, the assembly of spacer blocks or compression blocks can be held between the compression rails.

Stairways made according to this invention have many advantages in respect to construction heretofore known. Indeed, it is enough to envisage spacer blocks of various heights to see how easy it is to deliver from stock stairs of variable heights necessary to deal with various dimensions between two landings. Besides this type of stairway is simple and economical to build and very easy to install, even by non-professionals.

As has already been said, this stairway can be built advantageously of wood, metal, plastic or other materials.

One can make to order stairways the flight of which is straight, turning, curved or circular. It is only necessary in the latter cases to prepare the spacer blocks and the curved stair treads in appropriate form. Finally, the invention is equally adapted to stairways having balanced treads, that is to say rounded off in the change of direction.

I claim:

1. A stairway comprising a plurality of treads, a plurality of spacer blocks, each tread being gripped at one of its side edges between two spacer blocks functioning as stringers, each spacer block having upper and lower free edges, and a mortise located in each of those free edges, the mortise in the lower edge of a block located under a tread and the mortise in the upper edge of an adjacent block located above said tread being symmetrically positioned in relation to the tread, each block having channels provided in it for interconnecting through a tread the mortise in the upper edge of the block above a tread with the mortise in the lower edge of the block below a tread, and, compression means for drawing spacer blocks on opposite sides of each tread toward one another to compress a tread therebetween, said compression means being located in said mortises and said channels.

2. A stairway according to claim 1 further comprising banisters supported from said compression means.

3. A stairway according to claim 1 in which the bottoms of the mortises are substantially mutually parallel.

4. A stairway according to claim 3 in which the bottoms of the mortises are inclined in relation to the plane of the treads.

5. A stairway according to claim 1 in which the compression means comprise rods threaded at each end, nuts applied to said threaded ends, a metal piece perforated and lying between each nut and the bottom of a mortise whereby when the nut is drawn tight thrust is applied against said metal piece.

6. A stairway according to claim 5 in which each said metal piece is a plate having holes in it adapted to accomodate two rods.

7. A stairway according to claim 6 in which said plate is flat for lying parallel to a tread.

8. A stairway according to claim 6 in which said plate is flat at its ends but inclined therebetween for lying parallel to the run of the stairway.

9. A stairway comprising:

a plurality of horizontally extending treads, a plurality of spacer blocks each of which has horizontally extending top and bottom edges and upper and lower face side edges extending between the top and bottom edges, each of said treads being gripped at one of its side edges between two of said spacer blocks, each of said spacer blocks having a mortise on the upper side edge thereof and a mortise on the lower side edge thereof, the lower mortise of the block under each respective one of said treads and the upper mortise of the adjacent block above each respective tread being symmetrically positioned relative to the tread, each end of each of said blocks having a pair of vertically extending channels defined therein to interconnect the lower mortise of the block under each respective one of the treads and the upper mortise of the adjacent block above each respective tread through that respective tread, a rod, threaded at each end, in each of said channels, nuts threadingly fitted on the ends of said rods, a metal plate in the bottom of each of said mortises, each plate being flat and perforated at its ends but inclined therebetween along a line parallel to the run of the stairway, the ends of said rods extend through the perforations in the ends of said plates, and each metal plate is held between the respective nut and the bottom of the respective mortise in which that plate is positioned.

10. A stairway comprising:

a plurality of horizonally extending treads, a plurality of spacer blocks each of which has horizonally extending top and bottom edges and upper and lower free side edges extending between the top and bottom edges, each of said treads being gripped at one of its side edges between two of said spacer blocks, each of said spacer blocks having a pair of mortises on the upper side thereof and a pair of mortises on the lower side thereof, the lower pair of mortises on the block under each respective one of said treads and the upper pair of mortises of the adjacent block above each respective tread being summetrically positioned relative to the tread, each end of each of said blocks having a pair of vertically extending channels defined therein to interconnect the lower pair of mortises of the block under each respective one of the treads and the upper pair of mortises of the adjacent block above each respective tread through that respective tread, a rod, threaded at each end, in each of said channels, nuts threadingly fitted on the ends of said rods, a washer in the bottom of each of said mortises, the ends of the said rods extend through the washers, and each washer is held between the respective nut and the bottom of the respective mortise in which that washer is positioned.

11. A stairway comprising:

a plurality of horizontally extending treads, a plurality of spacer blocks each of which has horizontally extending top and bottom edges and upper and lower free side edges extending between the top and bottom edges, each of said treads being gripped at one of its side edges between two of said spacer blocks, each of said spacer blocks having a mortise on the upper side edge thereof and a mortise on the lower side edge thereof, the lower mortise of the block under each respective one of said treads and the upper mortise of the adjacent block above each respective tread being symmetrically positioned relative to the tread, each end of each of said blocks having a pair of vertically extending channels defined therein to interconnect the lower mortise of the block under each respective one of the treads and the upper mortise of the adjacent block above each respective tread through the respective tread, a rod, threaded at each end, in each of said channels, nuts threadingly fitted on the ends of said rods, a horizontally extending perforated flat metal plate in the bottom of each of said mortises, the ends of said rods extend through the perforations in the ends of said plates, and each metal plate is held between the respective nut and the bottom of the respective mortise in which that plate is positioned.

* * * * *